US005227749A

United States Patent [19]

Raguenet et al.

[11] Patent Number: 5,227,749

[45] Date of Patent: Jul. 13, 1993

[54] STRUCTURE FOR MAKING MICROWAVE CIRCUITS AND COMPONENTS

[75] Inventors: Gérard Raguenet, Portet sur Garonne; Olivier Remondière, Frouzins, both of France

[73] Assignee: Alcatel Espace, Courbevoie, France

[21] Appl. No.: 527,903

[22] Filed: May 24, 1990

[30] Foreign Application Priority Data

May 24, 1989 [FR] France ..... 89 06783

[51] Int. Cl.[5] ..... H01P 3/08; H01Q 1/38

[52] U.S. Cl. ..... 333/246; 343/700 MS

[58] Field of Search ..... 333/246, 238, 247; 343/700 MS, 700

[56] References Cited

U.S. PATENT DOCUMENTS

| | | | |
|---|---|---|---|
| 2,721,312 | 10/1955 | Grieg et al. | 333/238 |
| 2,919,441 | 12/1959 | Chu | 343/810 |
| 3,534,299 | 10/1970 | Eberhardt | 333/246 |
| 3,696,433 | 10/1972 | Killion et al. | 333/238 |
| 3,868,594 | 2/1975 | Cornwell et al. | 333/238 |
| 3,908,185 | 9/1975 | Martin | 333/247 |
| 3,936,864 | 2/1976 | Benjamin | 333/247 |
| 4,623,893 | 11/1986 | Sabban | 343/700 |
| 4,651,159 | 3/1987 | Ness | 343/700 MS |

FOREIGN PATENT DOCUMENTS 2194101 2/1988 United Kingdom .

OTHER PUBLICATIONS

Patent Abstracts of Japan, vol. 5, No. 55 (E-52)[727], Apr. 16, 1981; & JP-A-56 6502 (Nippon Denshin Denwa Kosha) Jan. 23, 1981.

*Primary Examiner*—Paul Gensler

*Attorney, Agent, or Firm*—Sughrue, Mion, Zinn, Macpeak & Seas

[57] ABSTRACT

The invention relates to a structure for making microwave circuits and components, in which the mechanical and electrical functions are integrated overall but dissociated locally. The invention is particularly suitable for space applications.

12 Claims, 2 Drawing Sheets

STRUCTURE FOR MAKING MICROWAVE CIRCUITS AND COMPONENTS

The present invention relates to a structure for making microwave circuits and components.

BACKGROUND OF THE INVENTION

The increasing development in the use of electromagnetic waves in fields as diverse as telecommunications, medical applications, radar, . . . , leads to implementation techniques being varied firstly to control wave propagation and secondly to control wave radiation. In both cases, the means implemented are defined not only by the general radio characteristics required: frequency bands; power requirements; admissible losses; interconnection coplexity; and mission in the broad sense of the term; but also by a set of other criteria that are not specifically concerned with radio, including parameters such as mass, circuit volume, or acceptable temperature range over which the technology used must be capable of operating. These additional criteria also come under the heading "mission in the broad sense of the term". The particular technology chosen must satisfy both radio criteria and criteria that are mechanical, structural, and thermal.

It will readily be understood that environmental and installation conditions differ for microwave equipment depending on whether it is installed on board a satellite, an aircraft, or a submarine, for example, and that this has an impact on the way the technology required for making the equipment is defined and selected.

There is no doubt that the best known means for conveying an electromagnetic wave is a hollow tube. It may be simple in shape being rectangular or circular in section or it may be more complicated, e.g. being hexagonal in section. The applicable range of frequencies is very wide, running from a few gigahertz to several hundred gigahertz, i.e. from centimetric waves to submillimetric waves. Below a few megahertz, waveguides are difficult to use because of their size and mass. Other types of propagation are then used.

A non-exhaustive list includes the following:

coaxial lines and derivatives thereof;

three-plate lines, and microstrip lines and derivatives thereof.

These various means are in widespread use for propagating signals from DC to a few tens of gigahertz. Put simply, it may be said that radio properties (impedance, propagation constant, etc. . . . ) result from the positioning of two conductors relative to each other by means of a support material or a dielectric spacer. In practice, the materials commonly used have dielectric constants lying in the range 1 to 10, and they may be as much as 40 in some applications.

So far as radiation is concerned, radiating elements have appeared over the last ten years which are remarkable both as to their simplicity of manufacture and as to their characteristics of lightness and ability to be shaped. These elements are printed antennas ("patches") based on using a resonant element etched on a dielectric support, with the assembly being implanted on a ground plane. Here again, these concepts make it possible to propose solutions which are very competitive in terms of volume, compactness, and mass.

These two centers of interest (making circuits, and making the radiating elements) have led manufacturers to offer an ever increasing range of dielectric materials having wider and wider fields of application.

The constraints for utilization in the space environment are well known and generally bear on:

equipment mass;

temperature ranges and thermal stresses;

vibration levels; and physical stability in a vacuum (no degassing).

The object of the invention is to provide substrates of variable permittivity.

SUMMARY OF THE INVENTION

To this end, the invention provides a structure for making microwave circuits and components, in which mechanical and electrical functions are integrated overall, but are dissociated locally; with a mechanical structure constituting an enclosure in which a volume of dielectric is disposed. A layer of dielectric material is disposed on either side of the assembly comprising the mechanical structure and the volume of dielectric, with one of the layers supporting a conductive element disposed above the volume of dielectric and with the other supporting a metal ground plane, a layer of glue being disposed between the mechanical structure and each of the two dielectric layers.

The advantage of the invention lies in its versatility and in its considerable weight saving compared with more conventional solutions. The ease with which it can provide dielectrics of arbitrary constants and its low mass make this solution very attractive for use in space.

BRIEF DESCRIPTION OF THE DRAWINGS

An embodiment of the invention is described by way of example with reference to the accompanying drawings, in which.

DETAILED DESCRIPTION

Figure 1:
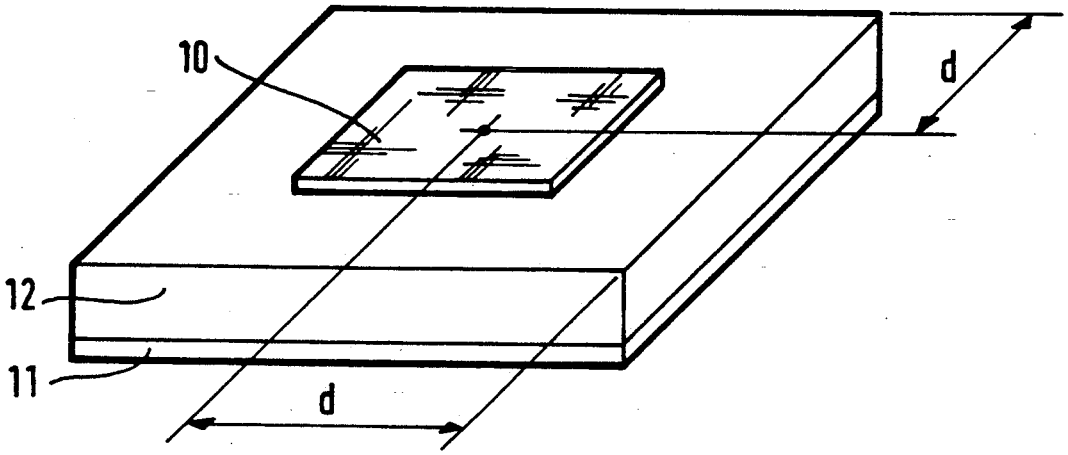
FIG.1 PRIOR ART
FIGS. 1, 2, and 3 show prior art embodiments.

In order to make a structure (either a circuit structure or a propagation structure) as shown in FIG. 1, the main design problem is to keep a conductor element 10 at an accurate distance from one ground plane 11 or from two ground planes, as the case may be.

The medium 12 as delimited in this way by the conductive element 10, the, or each, ground plane 11, and a characteristic distance d chosen during design as a function of its influence on the interaction phenomena between the electromagnetic field and the substance contained in the medium, must have electrical characteristics of dielectric constant ($\epsilon_r$) and of loss factor (tan $\delta$) as selected by the designer.

Also, the performance of the device as a whole must be compatible with its utilization. For example, in a space application, the main performance requirements are:

lightness;

stiffness;

resistance to high temperatures (typically 130° C.);

low degassing; and dimensional stability (low coefficient of temperature expansion, low coefficient of expansion by desorption of moisture, high heat conductivity).

Several solutions from the radio point of view are in common use.

Figure 2:
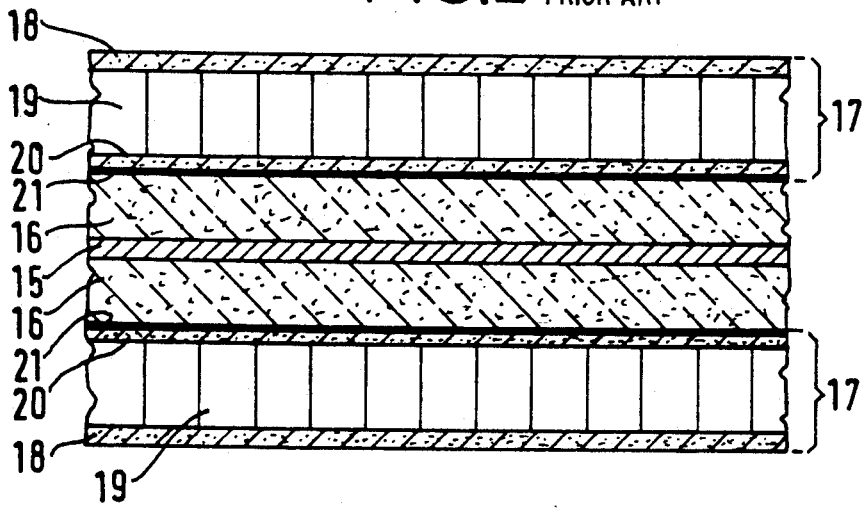
FIG.2 PRIOR ART

Thus, for a propagation circuit, considerable stiffness can be imparted to the ground planes 17 in the manner shown in FIG. 2, and it is thus possible to hold the conductor 15 and the dielectric material 16 in place between them. The central conductor 15 is then disposed between two layers 16 of dielectric material and two structures 17 constituting the ground plane and which are situated on either side of the assembly. Each of these structures is formed, for example, by a sandwich comprising an outside carbon skin 18, an aluminum honeycomb 19, and an inside carbon skin 20, with the inside carbon skin 20 having a metal coating 21. The dielectric material 16 may be made from a honeycomb, an organic foam, or dielectric spacers, for example.

The dielectric material 16 is selected for its radio performance, thereby giving a wide range of choice. A high performance solution can thus be obtained from the radio point of view. However, the combination of mechanical parts (stiffening of the ground planes, and holding of the central conductor and of the dielectric medium) gives rise to poor mechanical performance. This type of solution is therefore well suited to devices that are small in size (typically having an area of less than 0.5 $m^2$) and/or for devices where the ground planes are used to provide additional mechanical functions (e.g. holding helical or horn type radiating elements).

Figure 3:
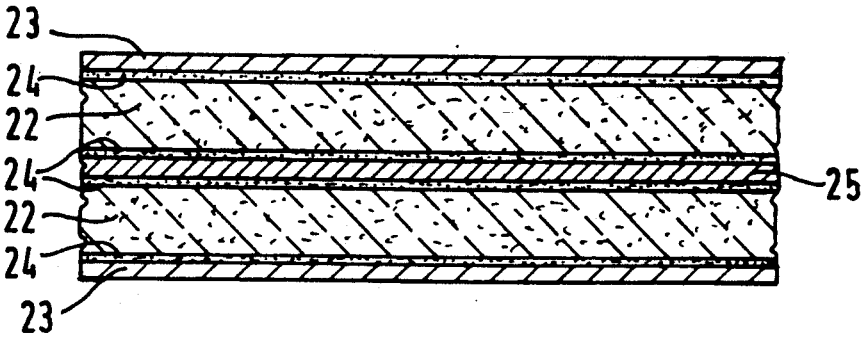
FIG.3 PRIOR ART

When high mechanical performance is required (for large antennas, for example), radically different solutions are generally used. These consist in totally integrating the mechanical and electrical functions. As shown in FIG. 3, this is achieved by making the dielectric material 22 participate in obtaining the mechanical stiffness of the assembly, in particular by gluing. There is then a central metal conductor 25 disposed between two dielectric layers 22, and two metal planes 23 constituting ground planes, with layers of glue 24 being situated between each of the contacting planes. It is then advantageous to use materials having high specific stiffness (e.g. composite materials) as far away as possible from the neutral axis of the sandwich (top and bottom surfaces of the panel), and to glue between these faces a material having good shear properties and low density (e.g. a honeycomb structure). This technique is well adapted to making large sized devices where it is desirable to obtain very low mass per unit area (antennas, spreaders, typically 5 $kg/m^2$). The constraints to be taken into account when choosing the dielectric material are very severe, since the material must satisfy radio requirements, mechanical requirements, and environmental requirements. A good compromise can usually be reached, but electrical performance is not always satisfactory (too high a loss factor due to the presence of films of glue) and mechanical performance may be degraded (for example if it is desired to use a dielectric having a constant greater than 2 and a thickness greater than 1 millimeter).

The invention provides a mechanically stiff structure in which the electrical and mechanical functions are integrated overall, but are dissociated locally.

Figure 4:
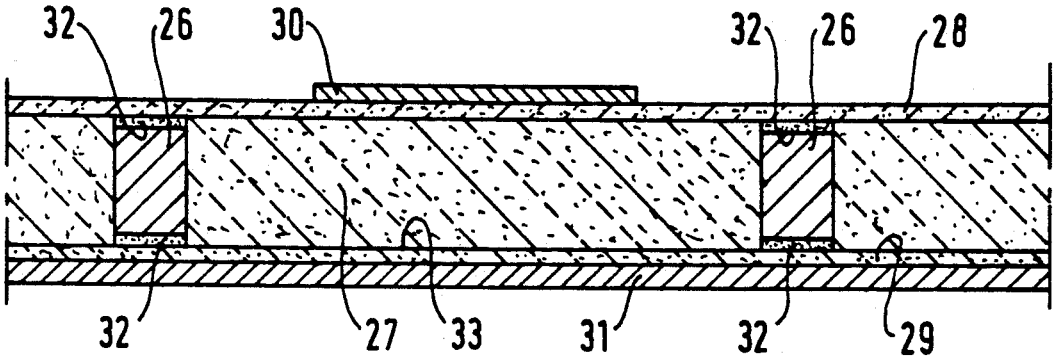
FIGS. 4 and 5 are a section view and a partially cutaway plan view of a structure of the invention for microwave circuits and components.
Figure 5:
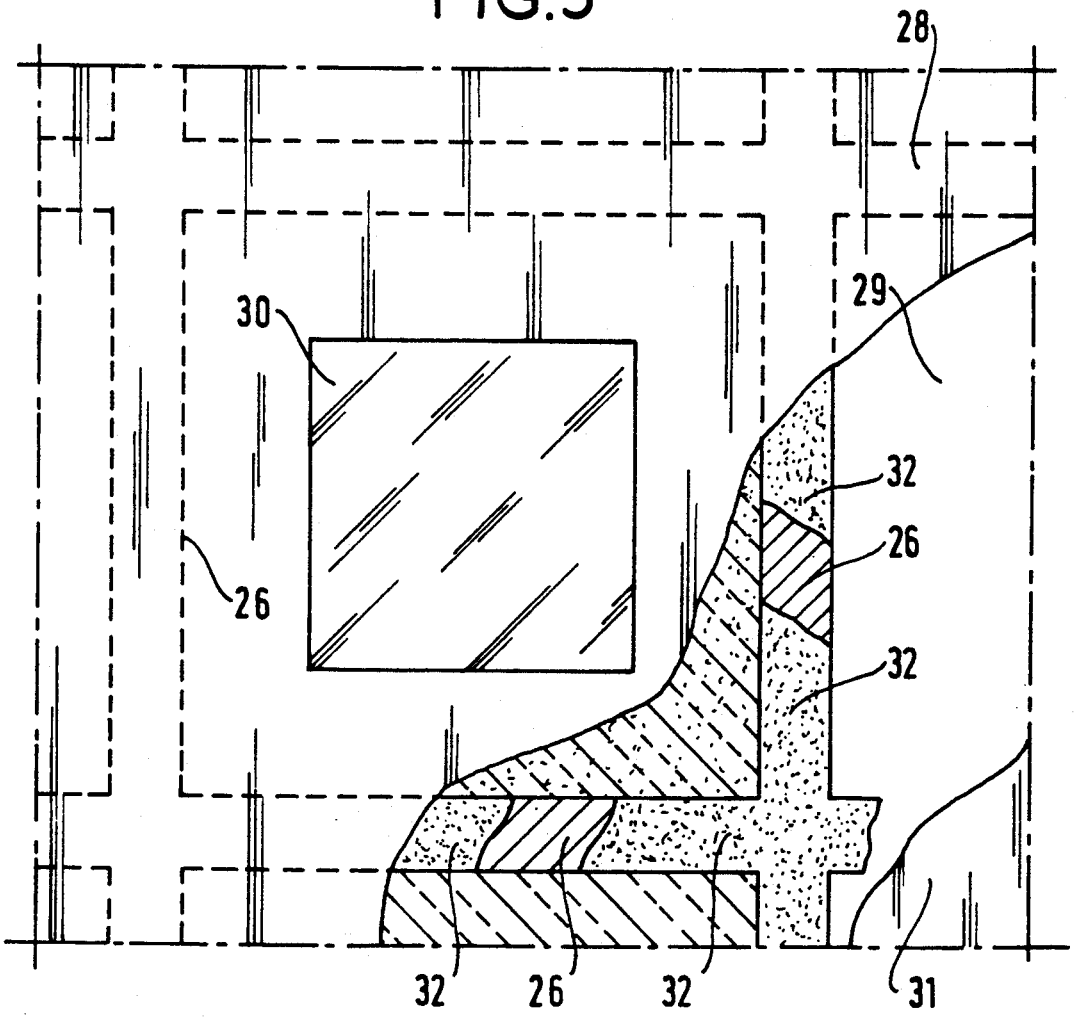

As shown in FIGS. 4 and 5, the structure of the invention comprises a mechanical structure 26 forming a hollow enclosure 33 in which a slab 27 of dielectric may be disposed. A layer of dielectric material 28 (29) is disposed on either side of a mechanically stiff assembly formed in this way, with the first layer 28 supporting the conductive element 30 which is disposed over the slab 27 of dielectric, while the other layer 29 supports the metal ground plane 31. A layer of glue 32 is disposed between the mechanical structure and each of the two dielectric layers.

Thus, in a structure of the invention, the medium in the vicinity of the conductive element is constituted by a dielectric selected principally for its electrical characteristics ($\epsilon_r$, tan $\delta$) which dielectric does not participate in providing the mechanical stiffness of the assembly. Beyond this region, a mechanical structure serves to contain the above dielectric and to provide the overall mechanical performance of the device. The selection criteria for the materials constituting this structure are mainly mechanical (E/o, where E=Young's modulus, and o=density), and the mechanical structure may be very effective.

The advantages of the invention are as follows:

high and adjustable radio performance ($\epsilon_r$): any dielectric can be used, providing it is lightweight and can withstand the environment, in addition, a film of glue is not used; and high mechanical performance: the structure is made of mechanically sound material which may even include conductive material (e.g. a graphite-reinforced composite) if that is acceptable from the radio point of view.

In a first embodiment, it is desired to provide a printed antenna having a thickness h of 3 mm, for example, and having the following performance characteristics:

$\epsilon_r=2.5$;

tan $\delta$=as low as possible; and

E/o (specific stiffness) as high as possible.

Using prior art techniques, where mechanical and electrical functions are fully integrated, the best available materials are glass-reinforced polytetrafluoroethylene (PTFE) matrices. Although matrices of epoxy or polyimide are capable of providing better mechanical properties, their values of $\epsilon_r$ and tan $\delta$ are not so good.

The following table demonstrates this:

| Material | $\epsilon_r$ | tan $\delta \times 10^{-4}$ | E/o $\times 10^5$(SI) |
|---|---|---|---|
| Glass/PTFE | 2.5 | 9 | 6 |
| Quartz/polyimide | 3.6 | 40 | 100 |
| Kevlar/epoxy | 3.9 | 130 | 193 |

giving the following performance:

radiofrequency (RF) performance $$\tan \delta = 9{,}10^{-4}$$

mechanical performance y=6.99 $kg/m^2$ (raw mass per unit area: no connector, thermal control, . . . )

f=13 Hz (first resonant frequency for a square plane having a side of 0.5 m meters (11) with its edges being simply supported).

Whereas in a device of the invention, the dielectric is selected for its radio properties only. For example, using an alumina felt, it is possible to obtain o=750 $kg/m^3$, $\epsilon_r=2.5$, tan $\delta=2.10^{-4}$ (assuming linear variation of $\epsilon_r$ and of tan $\delta$ as a function of density).

The material constituting the structure is chosen mainly for its mechanical characteristics.

The performance obtained in this example are: radiofrequency $$\tan \delta = 2.10^{-4}$$

mechanical performance (using a Kevlar/epoxy structure having a thickness of 2 mm):

$f = 19.8$ Hz $y = 2.83$ kg/m$^2$

Using a device of the invention, the improvement may be factor of 4 on RF losses and a factor of about 2.5 on mass.

In a second embodiment a printed antenna may be made on a dielectric having a constant as close as possible to 1, with a patch to ground plane distance of 6 mm, with the desired performance being the same as in the first embodiment, with $\epsilon_r \approx 1$.

With prior art devices where mechanical and electrical functions are integrated, the most suitable architectures are obtained by gluing a highly aerated organic material (foam, honeycomb) between substrates supporting the radiating elements and the ground plane via films of glue or layers of composite materials.

The following performance is obtained: RF performance:

$\epsilon_r \approx 1.04$ $\tan \delta \approx 6.10^{-4}$ mechanical performance:

$y \approx 0.928$ kg/m$^2$ $f \approx 107$ Hz

In contrast, using the device of the invention, with the volume beneath the radiating element remaining empty, the following performance is obtained:

RF performance:

$\epsilon_r \approx 1$ $\tan \delta \approx 0$ mechanical performance (using a carbon fiber structure):

$y \approx 1.126$ kg/m$^2$ $f \approx 107$ Hz (resonant frequency unchanged).

For an increase in mass of about 20%, a radiating element is obtained having losses that are practically zero.

The component of the radiating element of the invention may be made using numerous materials, thus:

the mechanical structure 26 may be made of composite materials based, for example, on:

Kevlar;

carbon;

glass; or any other reinforcement.

The dielectric used may be:

ceramic ($\epsilon_r > 1$); (aerated ceramic, or ceramic fiber, or ceramic felt)

an organic or composite material ($\epsilon_r > 1$)

the volume may be filled with:

gas:

air; or vacuum.

Naturally, the present invention has been described and shown only by way of preferred example and its component parts could be replaced by equivalent parts without thereby going beyond the scope of the invention.

We claim:

1. A structure for use in the manufacture of microwave circuits and microwave components, in which mechanical and electrical functions are integrated overall but dissociated locally, comprising:

a mechanically stiff hollow enclosure contiguous with and surrounding a slab of dielectric material solely on the lateral sides of the dielectric slab and forming an assembly;

a conductive element and a metal ground plane disposed respectively on opposite, upper and lower sides of the mechanically stiff enclosure and the dielectric slab, to the outside of said assembly;

whereby the mechanically stiff enclosure provides a global support for a microwave circuit or component particularly useful in space applications having lightness, stiffness, resistance to high temperatures, low degassing and good dimensional stability, and wherein said mechanically stiff enclosure is made of one of an insulating material and a conductive material.

2. A structure according to claim 1, further comprising a first layer of dielectric material, supporting the conductive element disposed on said upper side of the assembly constituted by the slab of dielectric material surrounded by the enclosure.

3. A structure according to claim 2, further comprising a second dielectric layer, supporting the metal ground plane disposed on said lower side of said assembly constituted by the slab of dielectric material surrounded by the enclosure.

4. A structure according to claim 3, further comprising a layer of glue disposed between the enclosure and the slab of dielectric material and each of the two dielectric layers.

5. A structure according to claim 1, wherein the enclosure is made of composite material.

6. A structure according to claim 5, wherein the composite material used comprises KEVLAR fiber.

7. A structure according to claim 5, wherein the composite material used comprises carbon.

8. A structure according to claim 5, wherein the composite material used comprises glass.

9. A structure according to claim 1, wherein the dielectric used includes ceramic.

10. A structure according to claim 9, wherein the ceramic is aerated.

11. A structure according to claim 1, wherein the dielectric used includes an organic or composite material.

12. A structure according to claim 1, wherein said mechanically stiff hollow enclosure is formed of one material of the group consisting of KEVLAR ®, carbon and glass, and wherein said dielectric slab is formed of one material of the group consisting of aerated ceramic, ceramic fiber and ceramic felt.

* * * * *